US010381132B2

(12) United States Patent
Johnsen et al.

(10) Patent No.: US 10,381,132 B2
(45) Date of Patent: Aug. 13, 2019

(54) SELF-SUPPORTING CABLE

(75) Inventors: Ulf Johnsen, Falun (SE); Lars Efraimsson, Falun (SE)

(73) Assignee: NKT CABLES GROUP A/S, Brøndby (DK)

( * ) Notice: Subject to any disclaimer, the term of this patent is extended or adjusted under 35 U.S.C. 154(b) by 760 days.

(21) Appl. No.: 13/808,150

(22) PCT Filed: Jul. 6, 2010

(86) PCT No.: PCT/SE2010/050785
§ 371 (c)(1),
(2), (4) Date: Jan. 22, 2013

(87) PCT Pub. No.: WO2012/005638
PCT Pub. Date: Jan. 12, 2012

(65) Prior Publication Data
US 2013/0213687 A1 Aug. 22, 2013

(51) Int. Cl.
*H01B 7/02* (2006.01)
*H01B 7/18* (2006.01)
*H01B 9/00* (2006.01)

(52) U.S. Cl.
CPC ..... *H01B 7/18* (2013.01); *H01B 7/188* (2013.01); *H01B 9/008* (2013.01)

(58) Field of Classification Search
CPC ..... H01B 7/18; H01B 7/188; H01B 9/008; H01B 7/0208
(Continued)

(56) References Cited

U.S. PATENT DOCUMENTS 3,362,861 A * 1/1968 Barker ..... B29C 63/00 100/295
3,509,269 A * 4/1970 Elliott ..... H01B 7/28 174/120 R
(Continued)

FOREIGN PATENT DOCUMENTS

EP 0177475 A2 4/1986
EP 0461794 A1 12/1991

OTHER PUBLICATIONS

Ericsson; "AXCES 12/20(24)kV 3x95/25 Product Information"; 17/287 01-FGC 101 683 Rev F; pp. 1-2; Jul. 2, 2010; Ericsson AB; www.ericsson.com.
(Continued)

*Primary Examiner* — Chau N Nguyen
(74) *Attorney, Agent, or Firm* — Buchanan Ingersoll & Rooney P.C.

(57) ABSTRACT

The current invention relates to self-supporting cables that often are aerial mounted between cable fixing points (800) and where the conductors in the cables act as the bearing elements. In this type of cables, slip-page between the surfaces of different layers in the cable is undesirable. On the other hand, it must be possible to easily bend the cable, even for larger dimensions. Both these requirements are difficult to meet with the solutions from prior art. The present invention overcomes this by introducing an intermediate layer (130) in the cable (100) located between and adhered to the surfaces (112, 121) of the layers and having a frictional inner structure allowing the two surfaces (112, 121) to slip relatively each other in longitudinal direction enough so that the cable (100) can be bent but prevents the two surfaces {112, 121) from slipping in response to an inwardly directed radial pressure force (F) at the cable fixing points (800).

19 Claims, 8 Drawing Sheets

(58) Field of Classification Search
USPC ..... 174/124 R, 103, 120 R
See application file for complete search history.

(56) References Cited

U.S. PATENT DOCUMENTS

| | | | | |
|---|---|---|---|---|
| 3,843,830 | A * | 10/1974 | Priaroggia et al. | 174/102 D |
| 4,397,807 | A * | 8/1983 | Bahder | H01B 12/02<br>264/512 |
| 4,956,523 | A | 9/1990 | Pawluk | |
| 5,455,392 | A * | 10/1995 | Preu | C08J 9/06<br>174/110 F |
| 6,288,339 | B1 | 9/2001 | Efraimsson et al. | |
| 2008/0081171 | A1 * | 4/2008 | DuPont | 428/297.7 |

OTHER PUBLICATIONS

Ericsson, "N1XE 1 kV Product Information"; 18/287 01-FGC 101 680 Rev G; pp. 1-3; 2009; Ericsson AB; www.ericsson.com.

* cited by examiner

SELF-SUPPORTING CABLE

TECHNICAL FIELD

The present invention relates to a self-supporting cable.

BACKGROUND

It is known from prior art to make aerial cables self-supporting by using separate supporting elements. These could for example be a separate messenger wire of steel. This wire could be mounted along the cable as illustrated in the European patent EP0461794. The cable could also be twisted around the messenger wire in a spiral.

It is also known to provide cables of improved tensile strength by embedding supporting elements in the cable insulation as described in U.S. Pat. No. 4,956,523.

A disadvantage of using these supporting elements is that the cables become expensive to produce. A cable with a supporting element also becomes heavier and for steel messengers there is often a demand that the messenger wire should be grounded for safety reasons which complicates the mounting in cable fixing points.

An electrical cable comprises one or several conductors that are made out of aluminum or copper. One solution is therefore to let the conductor itself act as the supporting element.

The conductors are normally surrounded by a plurality of different layers or shields, conductor shields, insulation shields, screen etc. If the different layers and/or conductors within the cable are not adhered to each other it becomes easy to bend the cable as the layers/conductors can stretch and slip relatively each other. This slippage is however undesirable for self-supporting cables. To overcome the slippage an inwardly directed radial pressure force to the cable in the cable fixing points can be applied so that the slippage is avoided. This force needs however to be very strong and has the disadvantage of damaging the outermost layers of the cable.

A solution to avoid the slippage is to simply make the different layers/conductors adhere to each other (for example by gluing or melting). This has however the disadvantage that the cable will become difficult to bend and it will also be very difficult to separate the different layers/conductors from each other without damaging the cable when jointing or terminating.

In U.S. Pat. No. 6,288,339 layers with undulations are disclosed. This solution has the effect that the layers can slip relative each other to some extent when the cable is bent, but in response to a relatively low inwardly directed radial pressure force the undulated layers cam into each other whereby the slippage is avoided. However, the flexibility becomes somewhat limited for large dimension cables.

SUMMARY

It is the object of the invention to obviate at least some of the above disadvantages and to provide an improved self-supporting cable.

The problems and disadvantages are in the invention solved by an intermediate portion in the cable positioned between and adhered to the outer surface of an inner portion (e.g. a core with conductors) and the inner surface of an outer portion (e.g. a shield and/or a sheath). The intermediate portion has a frictional inner structure allowing the two surfaces to slip relatively each other in longitudinal direction enough so that the cable can be bent but prevents the two surfaces from slipping in response to an inwardly directed radial pressure force at cable fixing points.

The tension forces and the gravitational force acting on the cable between said cable fixing points can now be transmitted into the conductors and the cable will become self-supporting.

As an option, the intermediate portion is further arranged to split in response to an outwardly directed radial force applied to the outer portion so that the outer portion can easily be separated from the inner portion.

An advantage with the invention is that the cable is both easy to bend and can be mounted in cable fixing points such as dead end spirals without slippage between the layers. This applies also to large diameter cables.

Another advantage is that the orientation of the structure of the intermediate portion is not critical which makes the cable easier and less expensive to produce.

Yet another advantage is that the intermediate portion also reduces vibrations and oscillations when the cable is subject to strong winds.

The invention will now be described in more detail and with preferred embodiments and referring to accompanying drawings.

DETAILED DESCRIPTION

Figure 1A:
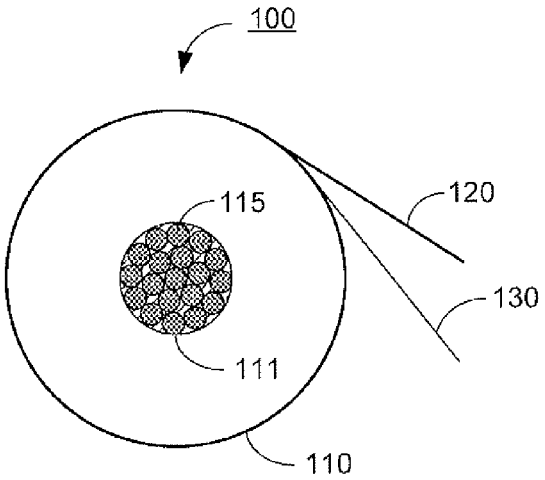
FIGS. 1*a* and 1*b* are block diagrams illustrating a radial and a longitudinal cross section of one embodiment of a cable according to the invention.
Figure 1B:
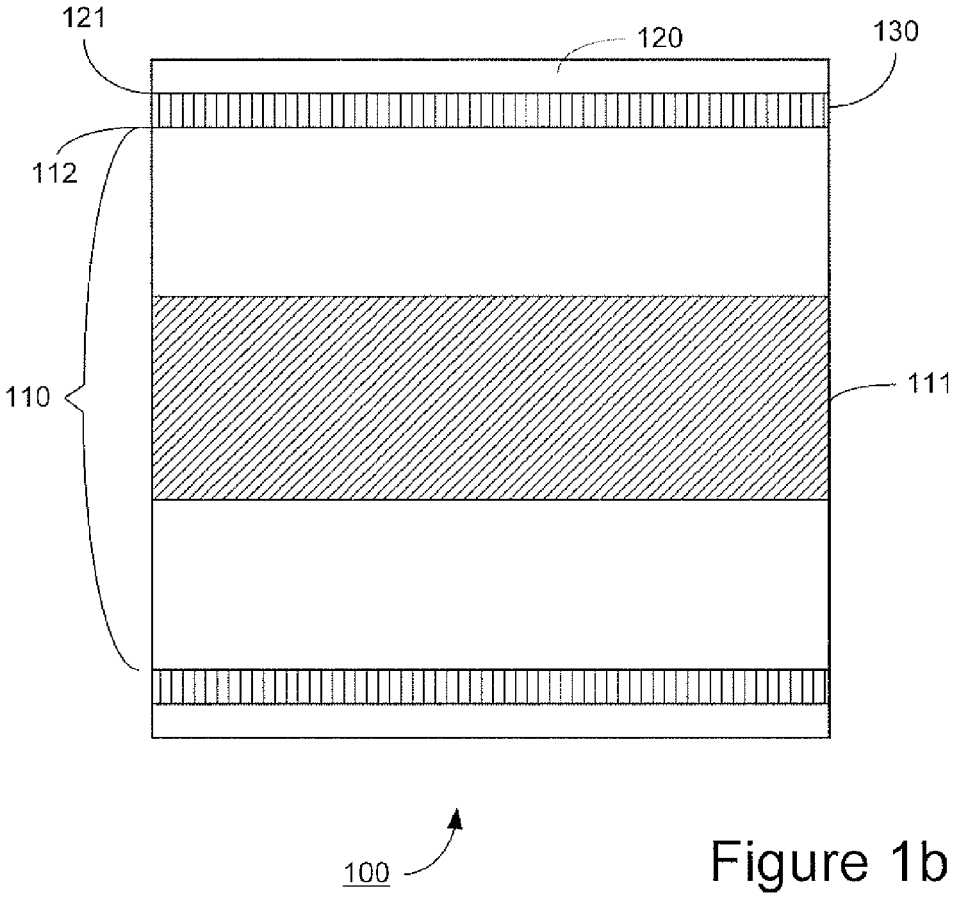
Figure 2:
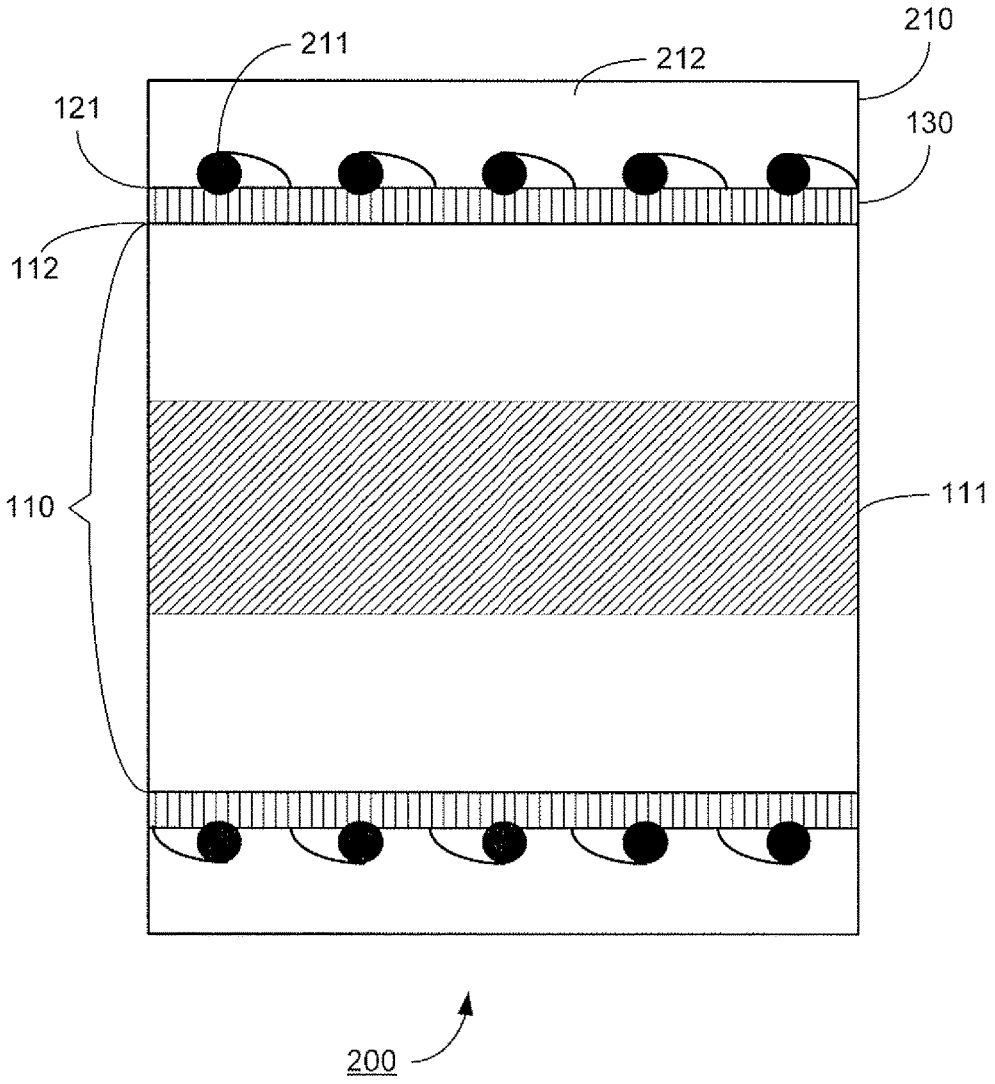
FIGS. 2 and 3 are block diagrams illustrating a longitudinal cross section of two additional embodiments of a cable according to the invention.

FIGS. 1*a* and 1*b* illustrates a radial and a longitudinal cross-section of a cable 100 according to the present invention. The cable 100 in FIGS. 1*a* and 1*b* comprises an inner portion 110 with an outer surface 112, an outer portion 120 with an inner surface 121 and an intermediate portion 130. The inner portion 110 comprises one or several conductors 111. Each conductor 111 often consists of a plurality of metal wires 115 (normally aluminum or copper). The inner portion 110 and the outer portion 120 can consist of one or several layers of different types, plastic isolating layer, metal shield, semi conductive shield, sheath etc. An example on a cable 200 with an outer portion 210 comprising a metal shield 211 and a plastic layer 212 is illustrated in FIG. 2. The plastic layer 212 has penetrated between the wires of the metal shield 211 by melting in the extrusion process.

Figure 3:
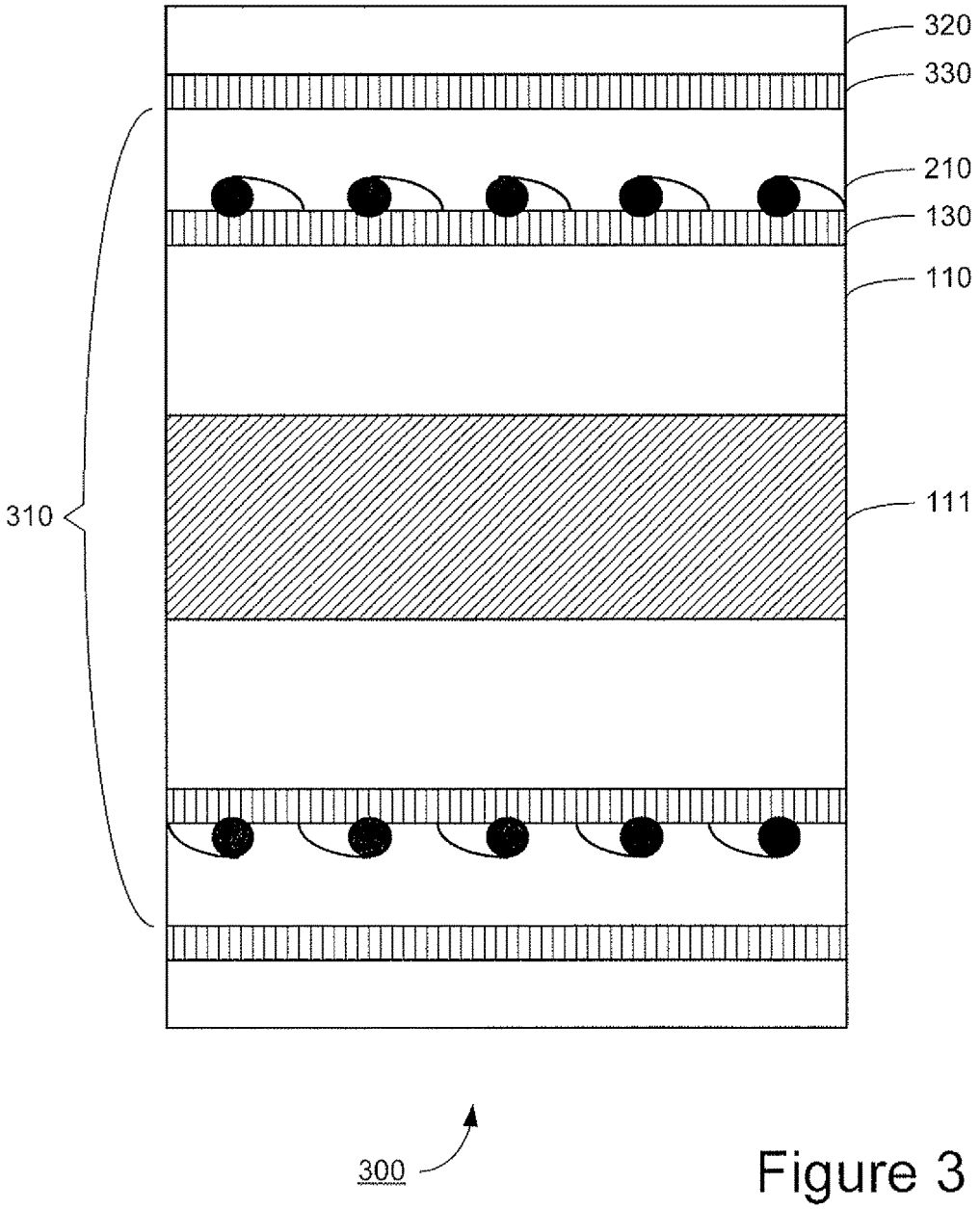

The embodiments of the invention illustrated by FIGS. 1*a*, 1*b* and 2 comprise only one intermediate portion 130. The inventive concept is however not limited to one intermediate portion 130 only but several intermediate portions can be used. This is illustrated in FIG. 3. What in FIG. 2 comprises a cable 200 with an outer portion 210 can in principle be regarded as the inner portion 310 of a cable 300 with yet another intermediate portion 330 and yet another outer portion 320.

Figure 4B:
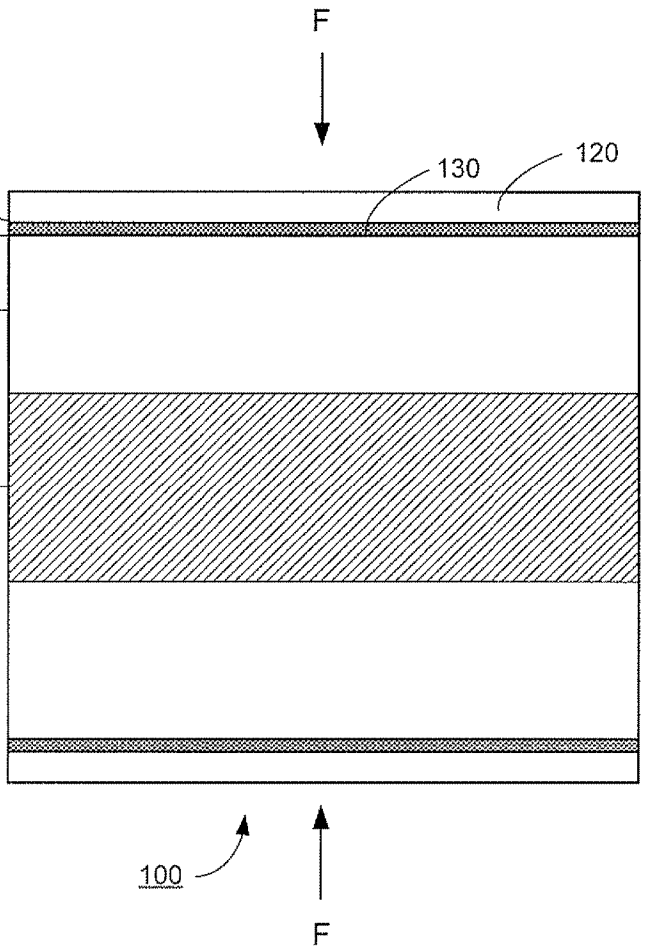
FIGS. 4*a* and 4*b* are block diagrams illustrating a bent cable and a cable subject to an inwardly directed radial pressure force.
Figure 4A:
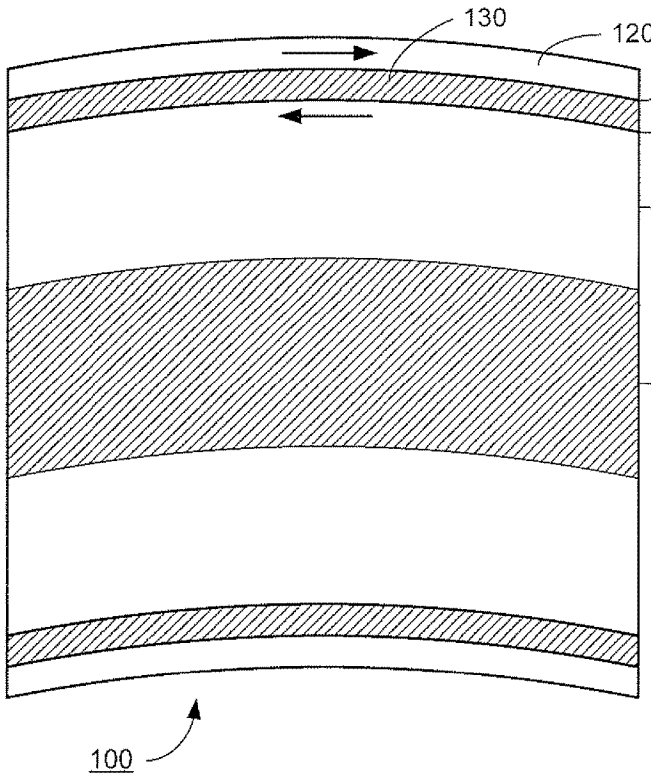

The main principle of the invention is illustrated in FIGS. 4*a* and 4*b*. The intermediate portion 130 is adhered to the two surfaces 112,121 and having a frictional inner structure allowing the two surfaces 112,121 to slip relatively each other in longitudinal direction so that the cable 100 can be bent as illustrated in FIG. 4*a*.

The friction within the inner structure of the intermediate portion 130 is further adapted to increase in response to an inwardly directed radial pressure force F at cable fixing points as to prevent the two surfaces from slipping. This is illustrated in FIG. 4*b*.

The tension forces and the gravitational force acting on the cable 100 between the cable fixing points can now be transmitted into the conductors 111 wherewith the cable 100 becomes self-supporting by virtue of the intrinsic mechanical strength of the conductors 111.

A preferred embodiment of an intermediate portion 130 comprises at least one sheet of a non-woven material adhered to the two surfaces 112, 121. It has been observed that a non-woven material with a fibrous structure is particular suitable. One example of such a non-woven material is crepe paper, or crêpe paper. Crepe paper is tissue paper typically having a thickness between 0.20 and 0.60 mm that has been coated with sizing and then "creped" to create gathers. Sizing is a material such as glue, gum, or starch, added to paper pulp to add sheen and stiffness, among other things. This gives crepe paper a distinct texture quite different from untreated tissue paper. Crepe paper has also the characteristics of being easy to stretch. Using adhered crepe paper as the intermediate portion 130, the friction within the crepe paper allows the cable 100 to easily be bent to some extent but when subject to the radial pressure force F the friction between the fibers in the crepe paper quickly increases and prevents the two surfaces 112, 121 from slipping. Crepe paper is relatively inexpensive, easy to wrap around the inner portion 110 of the cable 100 and has the same characteristics independent of orientation. It is also possible to use two or more sheets of crepe paper that are wrapped around each other.

Figure 5A:
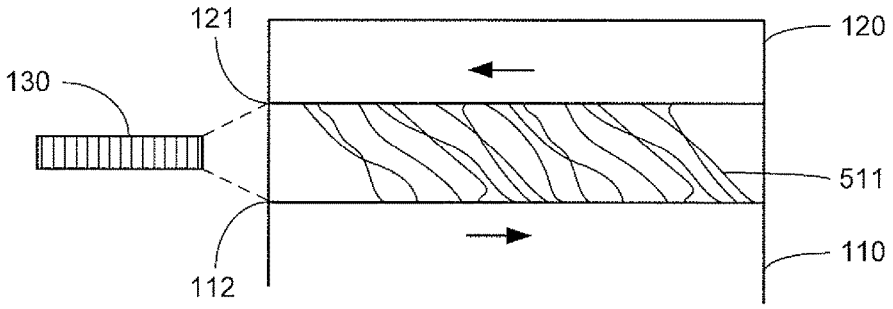
FIGS. 5*a*, 5*b* and 5*c* are block diagrams illustrating the behavior of the fibrous structure in the intermediate portion.
Figure 5B:
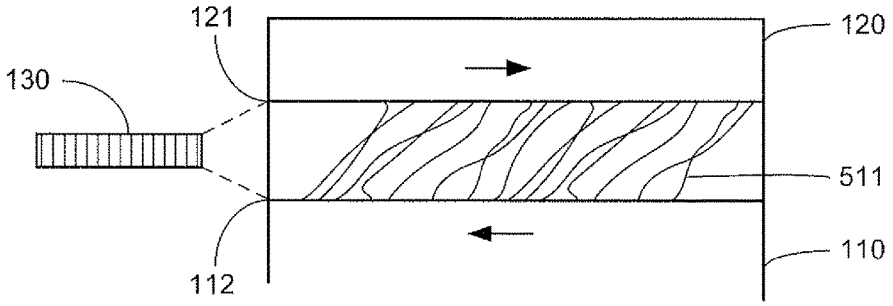
Figure 5C:
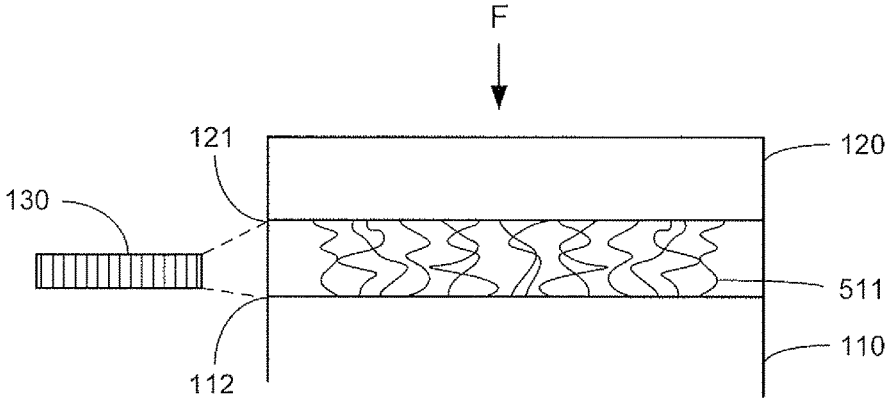

The behavior of the fibrous structure is illustrated in FIGS. 5*a* to 5*c*. When the cable 100 is not subject to any inwardly directed radial force, the fibers 511 in the intermediate portion 130 allow the two surfaces 112, 121 to slip to some extent relative each other as illustrated in FIGS. 5*a* and 5*b*. When subject to an inwardly directed radial force F, as in FIG. 5*c*, the friction between the fibers 511 quickly increases already when the thickness of the fibrous structure has decreased a few percent.

If the surfaces 112, 121 belong to plastic layers (which often is the case), it is possible to adhere the crepe paper to the two surfaces 112, 121 by heating. After the crepe paper has been wrapped around the inner plastic layer of the inner portion 110, the extrusion process melts the outer plastic layer on the crepe paper. The temperature in the extrusion process is set to be sufficient to also melt the outer surface 112 of the inner plastic layer at the same time. In the melting process, the two surfaces 112,121 of the plastic layers penetrate into the fibrous structure of the crepe paper whereby it becomes adhered to the two surfaces 112,121.

This adhering process also works if the outer portion 120 comprises a metal shield 211 as illustrated in FIG. 2. In this case the outer plastic layer both penetrates between the wires of the shield 211 and reaches and penetrates into the fibrous structure of the crepe paper.

Making the intermediate portion 130 to adhere to both the inner and outer portion 110,120 in one manufacturing step is a great advantage. Although not being a preferred embodiment, the intermediate portion 130 can also be adhered to the surfaces 112, 121 by gluing.

Figure 6:
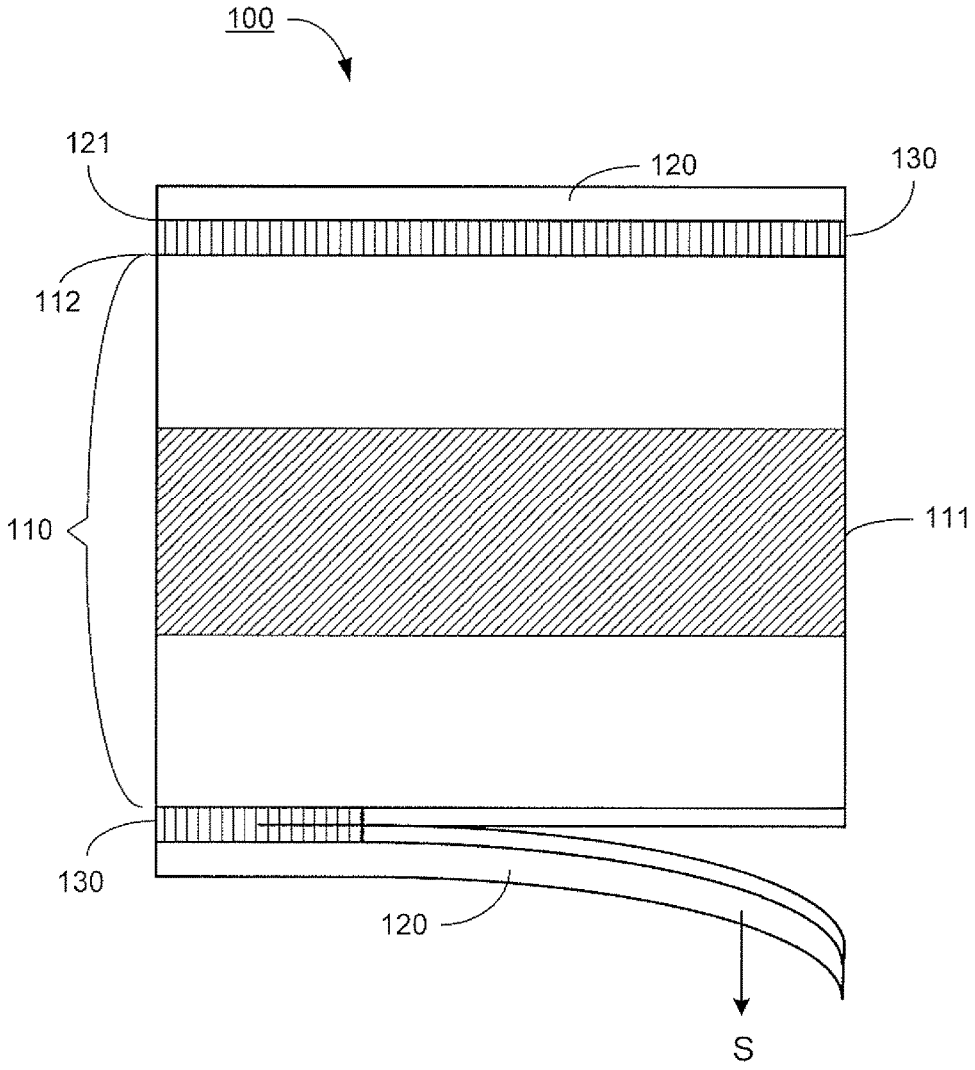
FIG. 6 is a block diagram illustrating a longitudinal cross section of a cable according to the invention with a separated outer portion.

The fibrous structure of the crepe paper further allows it easily to be split. This is illustrated in FIG. 6. This feature makes it easy to separate the outer portion 120 from the inner portion 110 of the cable 100 without damage by applying an outwardly directed radial force S to the outer portion 120. This feature is a great advantage when jointing or terminating the cable 100.

Yet another feature of the invention is that the intermediate portion 130 also reduces vibrations and oscillations of the cable 100. Vibrations and oscillations can occur when the cable 100 is subject to strong winds and can cause the cable 100 to come loose from its fixing points. The frictional structure of the intermediate portion 130 reduces the vibrations and oscillations as it transforms the kinetic energy from the relative movement between the two surfaces 112,121 to thermal energy (heat) due to the friction.

Although the FIGS. 1 to 6 only illustrate cables with one conductor 111, the inner portion 110 of the cable 100 can comprise a plurality of conductors. Two examples of this are illustrated in FIGS. 7*a* and 7*b*.

Figure 7A:
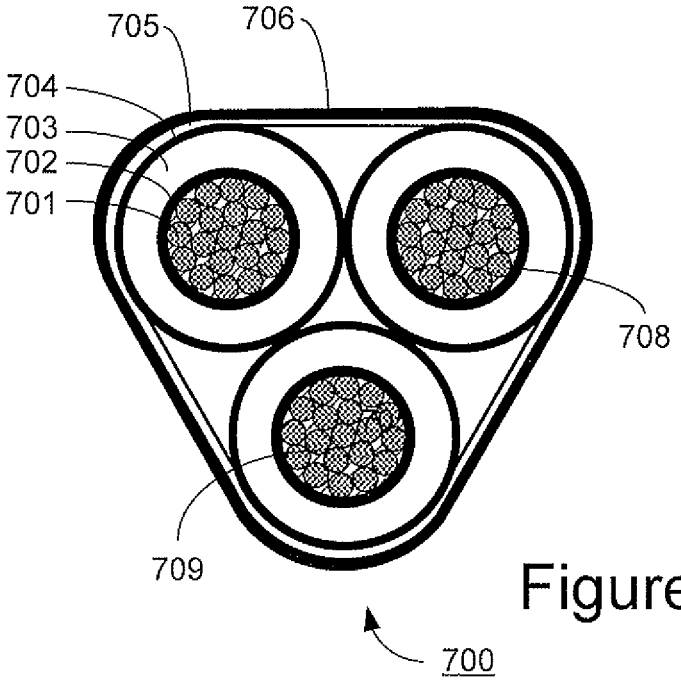
FIG. 7*a* is a block diagram illustrating a 3-core high voltage power cable comprising the present invention.

The cable 700 in FIG. 7*a* is a high voltage AXCES type of cable for 12 kV where the inner portion comprises three conductors 701, 708, 709 made of aluminum. Around each conductor 701 an inner conductive layer 702 of polyethylene, PE is extruded. Around the inner conductive layer 702 an insulation layer 703 of cross-linked polyethylene, PEX or XLPE is triple extruded. Around the insulation layer 703 a second conductive polyethylene layer 704 is extruded.

Around this inner portion, comprising the three conductors 701, 708, 709 each with its conductive and insulating layers 702,703,704, the intermediate portion 705 is mounted. The outer portion comprises screen wires or foil normally of copper or aluminum (not shown) wrapped around the intermediate portion 705. Finally, a black LLD PE (linear low density polyethylene) sheath 706 is extruded over the screen. The intermediate portion 705 comprises here a sheet of crepe paper. The LLD PE sheath 706 has penetrated through the copper shield and into the texture of the crepe paper 705 during the extrusion process. During the same process, the heat has also made the crepe paper 705 to adhere to the second conductive PE layer 704.

Figure 7B:
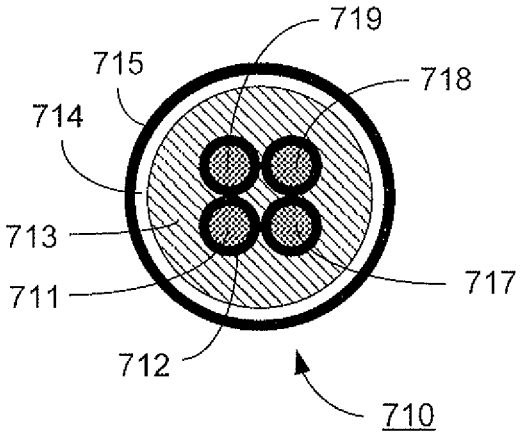
FIG. 7*b* is a block diagram illustrating a 1 kV power cable comprising the present invention.

The cable 710 in FIG. 7*b* is a N1XE type of cable for 1 kV with four conductors 711, 717, 718, 719. As this cable 710 is made for lower voltage the dimensions of the conductors 711, 717, 718, 719 are smaller. The four conductors 711, 717, 718, 719 can for example be of solid round copper (as in FIG. 7*b*), stranded round copper or of stranded sector shaped aluminum depending on cross section area. In this cable 710, the inner portion comprises the four conductors 711, 717, 718, 719 each having an insulation layer 712 of cross-linked polyethylene. Around the four conductors 711, 717, 718, 719 an inner covering 713 is extruded. Around this inner covering 713 the intermediate portion 714 of crepe paper is mounted and the outer portion of the cable comprises a black polyethylene sheath 715 extruded over the crepe paper 714. In a similar way as for the AXCES type of cable 700 above, the crepe paper 714 is adhered to the outer surface of the inner covering 713 and the inner surface of the polyethylene sheath 715 during the extrusion.

Figure 8:
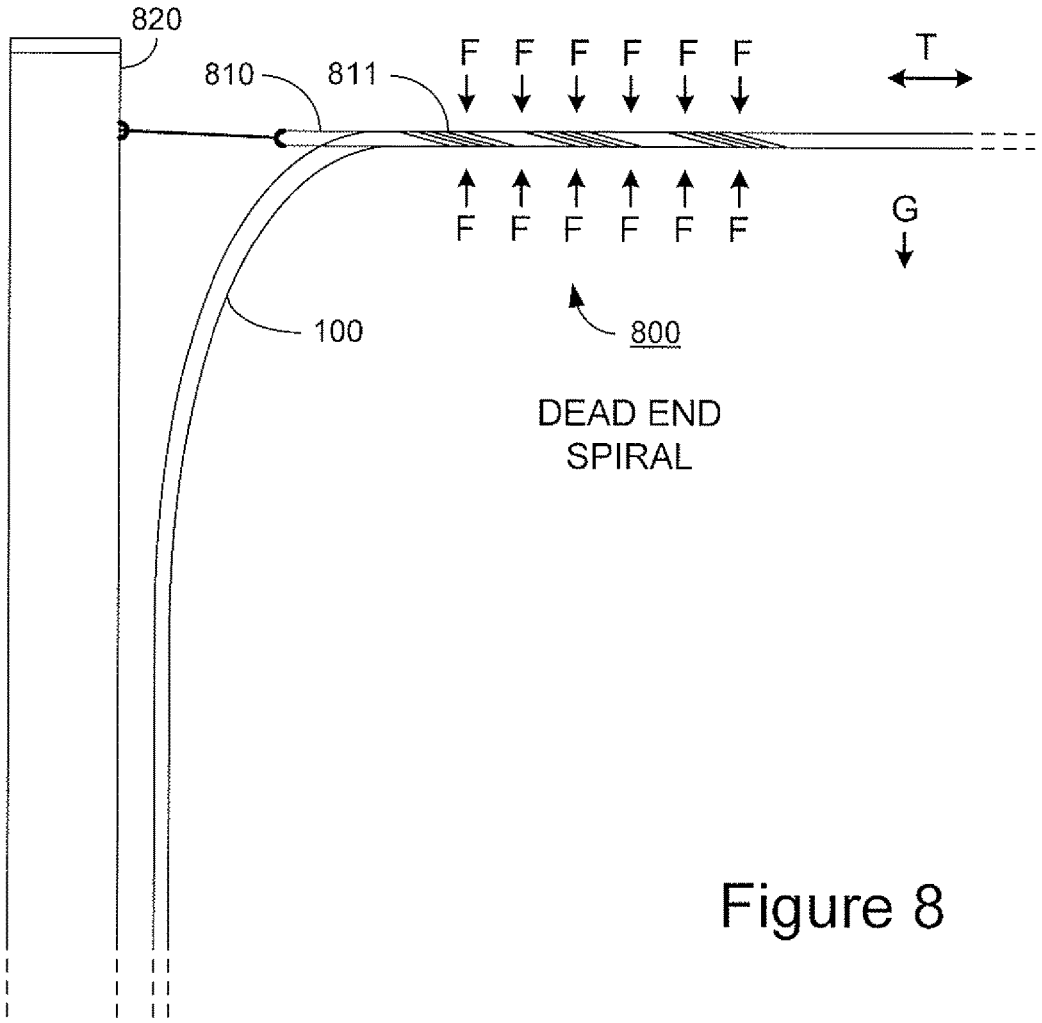
FIG. 8 is a block diagram illustrating a cable fixing point.

An example of a cable fixing point used for self-supporting cables is a so called dead end spiral. An example of a dead end spiral is illustrated in FIG. 8. In the fixing point 800, a metal wire 810 is twisted around the cable 100 in a spiral 811. The other end of the wire 810 is fixed to a pole 820. In order to not damage the outer layers of the cable 100 in the fixing point 800, the radial pressure forces F applied to the cable 100 must be relatively low. Therefore the spiral 811 extends up to two meters along the cable in order to distribute the radial pressure forces F to the cable. By applying relatively weak forces F to a cable 100 according to the present invention, tension forces T and the gravitational force G acting on the cable 100 are transmitted into the conductors 111 without slippage between the layers in the cable 100.

Although the embodiments described above mainly address electrical cables, the inventive concept can also be used for optical cables having an inner portion with a sufficient mechanical strength that allows the cable to be self-supporting.

The invention claimed is:

1. A self-supporting cable comprising:

an inner portion comprising at least one conductor and having an outer surface;

an outer portion having an inner surface and disposed outward from the inner portion, an outermost surface of the self-supporting cable including a polyethylene sheath;

an intermediate portion being of a fibrous structure positioned between and adhered to both the outer surface of the inner portion and the inner surface of the outer portion and having a frictional inner structure, said fibrous structure enabling said outer portion to be split from said inner portion;

the frictional inner structure of the intermediate portion allowing the outer surface of the inner portion and the inner surface of the outer portion to slip enough relative to each other in longitudinal direction so that the cable can be bent;

the cable being configured to bend under its own weight when fixed between the cable fixing points along a longitudinal extension of the cable, the frictional inner structure of the intermediate portion and its adherence on both sides thereof preventing the outer surface of the inner portion and the inner surface of the outer portion from slipping relative to each other in response to an inwardly directed radial pressure force at the cable fixing points, so that tension forces and gravitational force acting on the cable between the cable fixing points is transmitted to the conductors so that the cable is self-supporting by virtue of intrinsic mechanical strength of the conductors.

2. The cable of claim 1, wherein the intermediate portion comprises at least one sheet of a non-woven material.

3. The cable of claim 2:

wherein the sheet is adhered to both the outer surface of the inner portion and the inner surface of the outer portion, the fibrous structure of the intermediate portion including a fibrous structure of the sheet;

wherein both the outer surface of the inner portion and the inner surface of the outer portion have penetrated into the fibrous structure of the sheet in response to heating the outer surface of the inner portion and the inner surface of the outer portion above a predetermined temperature.

4. The cable of claim 2:

wherein the sheet has a fibrous structure comprising a plurality of fibers;

wherein the fibrous structure of the sheet is configured such that friction between the fibers of the sheet increases in response to the inwardly directed radial pressure force increasing.

5. The cable of claim 4, where the fibrous structure of the intermediate portion is further configured so as to split in response to an outwardly directed radial force applied to the outer portion to thereby allow the outer portion to be easily separated from the inner portion.

6. The cable of claim 4, wherein the non-woven material includes crepe paper.

7. The cable of claim 1 where the frictional inner structure of the intermediate portion is configured to transform kinetic energy to thermal energy when the outer surface of the inner portion and the inner surface of the outer portion move relative each other.

8. The cable of claim 1:

wherein the cable is an electrical cable;

wherein the at least one conductor comprises at least one metal wire.

9. The cable of claim 1, wherein the intermediate portion is adhered to both the outer surface of the inner portion and the inner surface of the outer portion by melt-adherence and/or glue.

10. The cable of claim 1, wherein the intermediate portion is melt-adhered to both the outer surface of the inner portion and the inner surface of the outer portion.

11. A self-supporting cable comprising:

an inner portion comprising at least one conductor and having an outer surface;

an outer portion having an inner surface and disposed outward from the inner portion, an outermost surface of the self-supporting cable including a polyethylene sheath;

an intermediate portion positioned between and melt-adhered and/or glued to both the outer surface of the inner portion and the inner surface of the outer portion and having a frictional inner structure;

the frictional inner structure of the intermediate portion allowing the outer surface of the inner portion and the inner surface of the outer portion to slip enough relative to each other in longitudinal direction so that the cable can be bent;

the cable being configured to bend under its own weight when fixed between the cable fixing points along a longitudinal extension of the cable, the frictional inner structure of the intermediate portion preventing the outer surface of the inner portion and the inner surface of the outer portion from slipping relative to each other in response to an inwardly directed radial pressure force at the cable fixing points, so that tension forces and gravitational force acting on the cable between the cable fixing points is transmitted to the conductors so that the cable is self-supporting by virtue of intrinsic mechanical strength of the conductors.

12. The cable of claim 11, wherein the intermediate portion comprises at least one sheet of a non-woven material.

13. The cable of claim 12:

wherein the sheet is adhered to both the outer surface of the inner portion and the inner surface of the outer portion;

wherein both the outer surface of the inner portion and the inner surface of the outer portion have penetrated into a fibrous structure of the sheet in response to heating the outer surface of the inner portion and the inner surface of the outer portion above a predetermined temperature.

14. The cable of claim 12:

wherein the sheet has a fibrous structure comprising a plurality of fibers;

wherein the fibrous structure of the sheet is configured such that friction between the fibers of the sheet increases in response to the inwardly directed radial pressure force increasing.

15. The cable of claim 14, where the fibrous structure of the sheet is further configured so as to split in response to an outwardly directed radial force applied to the outer portion to thereby allow the outer portion to be easily separated from the inner portion.

16. The cable of claim 14, wherein the non-woven material includes crepe paper.

17. The cable of claim 11 where the frictional inner structure of the intermediate portion is configured to transform kinetic energy to thermal energy when the outer surface of the inner portion and the inner surface of the outer portion move relative each other.

18. The cable of claim 11:

wherein the cable is an electrical cable;

wherein the at least one conductor comprises at least one metal wire.

19. The cable of claim 11, wherein the intermediate portion is melt-adhered to both the outer surface of the inner portion and the inner surface of the outer portion.

* * * * *